US006330798B1

(12) United States Patent
Stephenson

(10) Patent No.: US 6,330,798 B1
(45) Date of Patent: Dec. 18, 2001

(54) HYDRAULIC SYSTEM WITH SHADOW POPPET VALVE

(75) Inventor: Dwight Stephenson, Delafield, WI (US)

(73) Assignee: Husco International, Inc., Waukesha, WI (US)

( * ) Notice: Subject to any disclaimer, the term of this patent is extended or adjusted under 35 U.S.C. 154(b) by 0 days.

(21) Appl. No.: 09/573,751

(22) Filed: May 18, 2000

Related U.S. Application Data

(60) Provisional application No. 60/196,344, filed on Apr. 12, 2000.

(51) Int. Cl.[7] ..... F16D 31/02
(52) U.S. Cl. ..... 60/424; 91/524
(58) Field of Search ..... 60/424; 91/520, 91/523, 524; 251/30.01, 25; 137/596.15

(56) References Cited

U.S. PATENT DOCUMENTS 5,421,545 * 6/1995 Schexnayder ..... 251/30.02
6,149,124 * 11/2000 Yang ..... 251/30.03

* cited by examiner

*Primary Examiner*—Edward K. Look
*Assistant Examiner*—Thomas E. Lazo
(74) *Attorney, Agent, or Firm*—George E. Haas; Quarles & Brady LLP

(57) ABSTRACT

A hydraulic valve assembly includes a pilot operated proportional poppet valve in which the main poppet moves in response to pressure in a first control chamber. The pressure in a first control chamber is governed by a pilot poppet and movement of the main poppet controls fluid flow between a first inlet and a first outlet. A shadow poppet valve has a shadow poppet that controls fluid flow between a second inlet and a second outlet in response to pressure in a second control chamber. The first and second control chamber are connected together whereby the pilot operated proportional poppet valve and the shadow poppet valve open and close together. A unique hydraulic system utilizing a plurality of these hydraulic valve assemblies to operate two operators alternately in parallel or in series is described.

11 Claims, 3 Drawing Sheets

HYDRAULIC SYSTEM WITH SHADOW POPPET VALVE

This application claims benefit of U.S. Provisional Patent Application No. 60/196,344 filed Apr. 12, 2000.

BACKGROUND OF THE INVENTION

The present invention relates to hydraulic control systems, and particularly to systems in which a pair of hydraulic operators can be driven either in parallel or in series to power a common load.

Construction equipment such as hoists have moveable members that are driven by a hydraulic operator, such as a hydraulicly powered motor or a cylinder/piston arrangement. Application of hydraulic fluid to the operator traditionally was controlled by a manually operated valve, such as the one described in U.S. Pat. No. 5,579,642. This type of valve had a manual operator lever mechanically connected to a spool which could slide within a bore of the valve body. The pump and tank lines of the hydraulic system connected to ports of the valve body and the operator was coupled to workports on that valve body. Movement of the spool into various positions with respect to cavities in the bore enabled pressurized hydraulic fluid to flow from the pump to the operator and return to the tank also through the valve.

Manual valves are required to be mounted in the operator cab of the equipment thus requiring that a pair of hydraulic lines be run from each valve to the associated operator. There is a present trend away from manually operated hydraulic valves toward electrical controls and the use of solenoid valves. This type of control simplifies the hydraulic plumbing as the control valves do not have to be located in the operator cab. Instead the solenoid valves are mounted adjacent the operator, thereby requiring that only a common hydraulic line be run from the pump and a common return line be run back to the fluid tank. The solenoid valves distributed throughout the equipment connect to this single pair of hydraulic lines. Electrical controls are mounted in the cab with wires running to the respective solenoid valves. Wires are easier to run throughout the equipment and are less prone to failure than pressurized hydraulic lines.

Some hydraulic applications utilize a pair of operators to power a common load and power those operators in parallel or in series in different operating modes. For example, lift hoists utilize a pair of hydraulic motors to drive the cable spool which raises or lowers a load. The motors usually are often connected in parallel for greater power to lift heavy loads. The motors are connected in series to lower the load permitting increased speed of the cable spool when less power is required as gravity aids that lowering. In this application, the two operators typically are connected to a four-way spool valve and a series-parallel circuit that changes mode as commanded by operation of the spool valve. Such systems require two valve housings and intricate valving.

SUMMARY OF THE INVENTION

A hydraulic valve assembly includes a main control valve with a main valve poppet slidably located within a first bore to control flow of fluid between a first inlet into the first bore and a first outlet leading from the first bore. The main valve poppet defines a first control chamber in the first bore on a side of the main valve poppet that is remote from the first outlet. A selectively moveable pilot poppet engages and controls movement of the main valve poppet.

A shadow valve includes a shadow poppet slidably located within a second bore to control flow of fluid between a second inlet and a second outlet into and from the second bore. The shadow poppet defines a second control chamber in the second bore on a side of the shadow poppet that is remote from the second outlet. The second control chamber is in fluid communication with the first control chamber.

Movement of the pilot poppet affects pressure in the first control chamber which produces movement of the main valve poppet resulting in the main control valve opening and closing. Because the first control chamber is connected to the second control chamber, the shadow poppet moves in unison with the main valve poppet so that the shadow valve opens and closes synchronously with the main control valve.

In the preferred embodiment of the valve assembly, the pilot poppet is driven by an electrical actuator, such as a solenoid. This lends the main control valve to being operated by a electronic controller.

This type of hydraulic valve assembly is especially adapted for selective control of two hydraulic operators in either series or parallel. In this application, first, second and third valve assemblies couple the first and second operators to the pump and tank of the hydraulic system. Each valve assembly includes a main control valve and a shadow valve. The system also includes a conventional solenoid operated proportional valve.

The main control valve of the first valve assembly couples the pump to the first port of the first hydraulic operator, and the shadow valve of the first valve assembly connects the first port of the first hydraulic operator to the first port of the second hydraulic operator. The main control valve of the second valve assembly couples the first port of the first hydraulic operator to the tank, while the shadow valve of the second valve assembly connects the second port of the first hydraulic operator to the first port of the second hydraulic operator. The main control valve of the third valve assembly connects the second port of the first hydraulic operator to the tank, and the shadow valve of the third valve assembly couples the second port of the first hydraulic operator to the second port of the second hydraulic operator. The solenoid operated proportional valve couples the pump to the second port of the second hydraulic operator.

In a first mode of operation, the electronic controller applies electricity to the electric actuator of the first valve assembly and to the electric actuator of the third valve assembly, thereby operating the first and second operators in parallel. In a second mode of operation, the electronic controller applies electricity to the electric actuator of the proportional valve and to the electric actuator of the second valve assembly, thereby operating the first and second operators in series. Because only one valve in each assembly has a electric actuator, the complexity of the hydraulic system and its control are reduced as compared to a system having separate electric actuators for each valve.

DETAILED DESCRIPTION OF THE INVENTION

Figure 1:
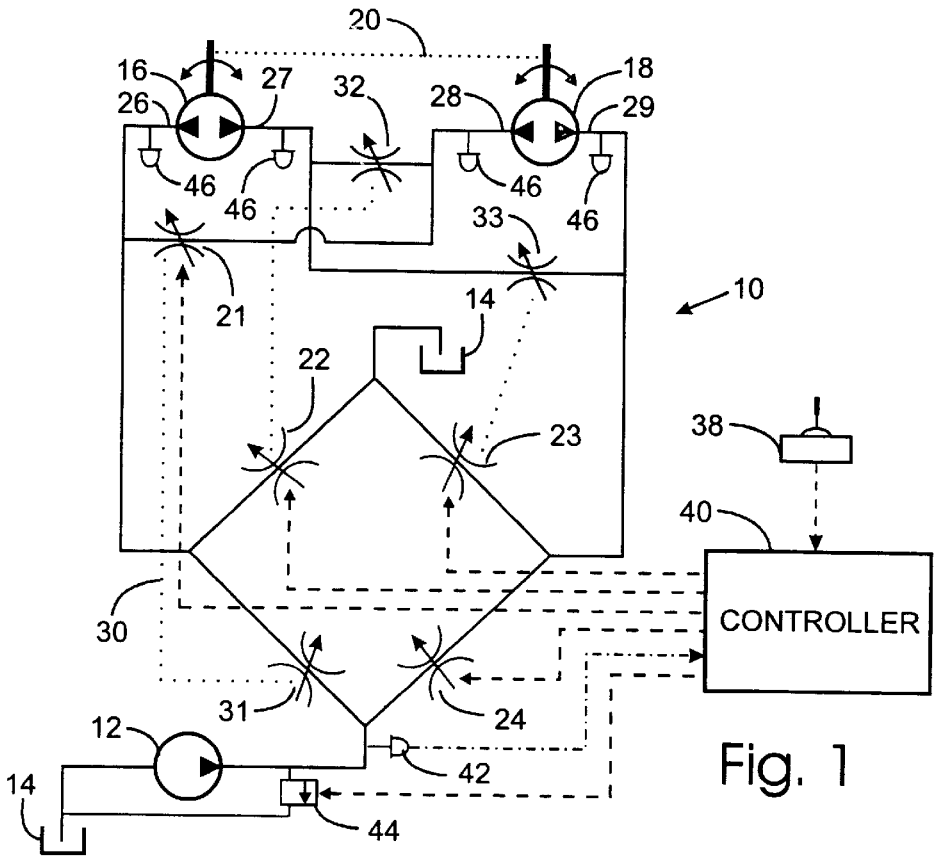
FIG. 1 is a schematic representation of a hydraulic system that incorporates the present invention.

With initial reference to FIG. 1, a hydraulic system 10 includes a pump 12 that draws fluid from a tank 14 and supplies the fluid to a pair of hydraulic operators which convert the hydraulic power into motion to drive mechanical load members. In the exemplary system 10, the hydraulic operators are motors 16 and 18 which are mechanically connected to a common load member as indicated by broken line 20. For example, the motors may be connected to a cable spool of a lift hoist or crane. Each motor 16 and 18 has a pair of ports and application of pressurized hydraulic fluid to one of those ports determines the direction in which the motor turns. The fluid exits the motor 16 or 18 from the other port and returns to the tank 14, as will be described.

The flow of hydraulic fluid between the pump 12 and the motors 16 and 18 is controlled by four proportional metering control valves 21, 22, 23 and 24. The first control valve 21 has an inlet connected to the first port 26 of the first motor 16 and an outlet connected to the first port 28 of the second motor 18. The inlet of the second control valve 22 is coupled to the first port 26 of the first motor 16 and the inlet of the third control valve 23 is coupled to the second port 29 of the second motor 18. The outlets of the second and third control valves 22 and 23 are both connected to the tank 14. The fourth control valve 24 has an inlet connected to the outlet of the pump 12 and an outlet coupled to the second port 29 of the second motor 18.

The hydraulic system 10 further includes a first shadow poppet valve 31 coupling the outlet of the pump 12 to the first port 26 of the first motor 16. As will be described, the operation of the first shadow poppet valve 31, as indicated by dotted line 30. Thus the first control valve 21 and the first shadow poppet valve 31 are considered as a first valve assembly. A second shadow poppet valve 32 is connected between the second port 27 of the first motor 16 and the first port 28 of the second motor 18. Operation of the second shadow poppet valve 32 is controlled by the second control valve 22. Thus the second control valve 22 and the second shadow poppet valve 32 are considered as a second valve assembly. A third shadow poppet valve 33 couples the second port 27 of the first motor 16 to the second port 29 of the second motor 18 second motor 18. The third control valve 23 controls operation of the third shadow poppet valve 33. The third control valve 23 and the third shadow poppet valve 33 form a third valve assembly.

Figure 2:
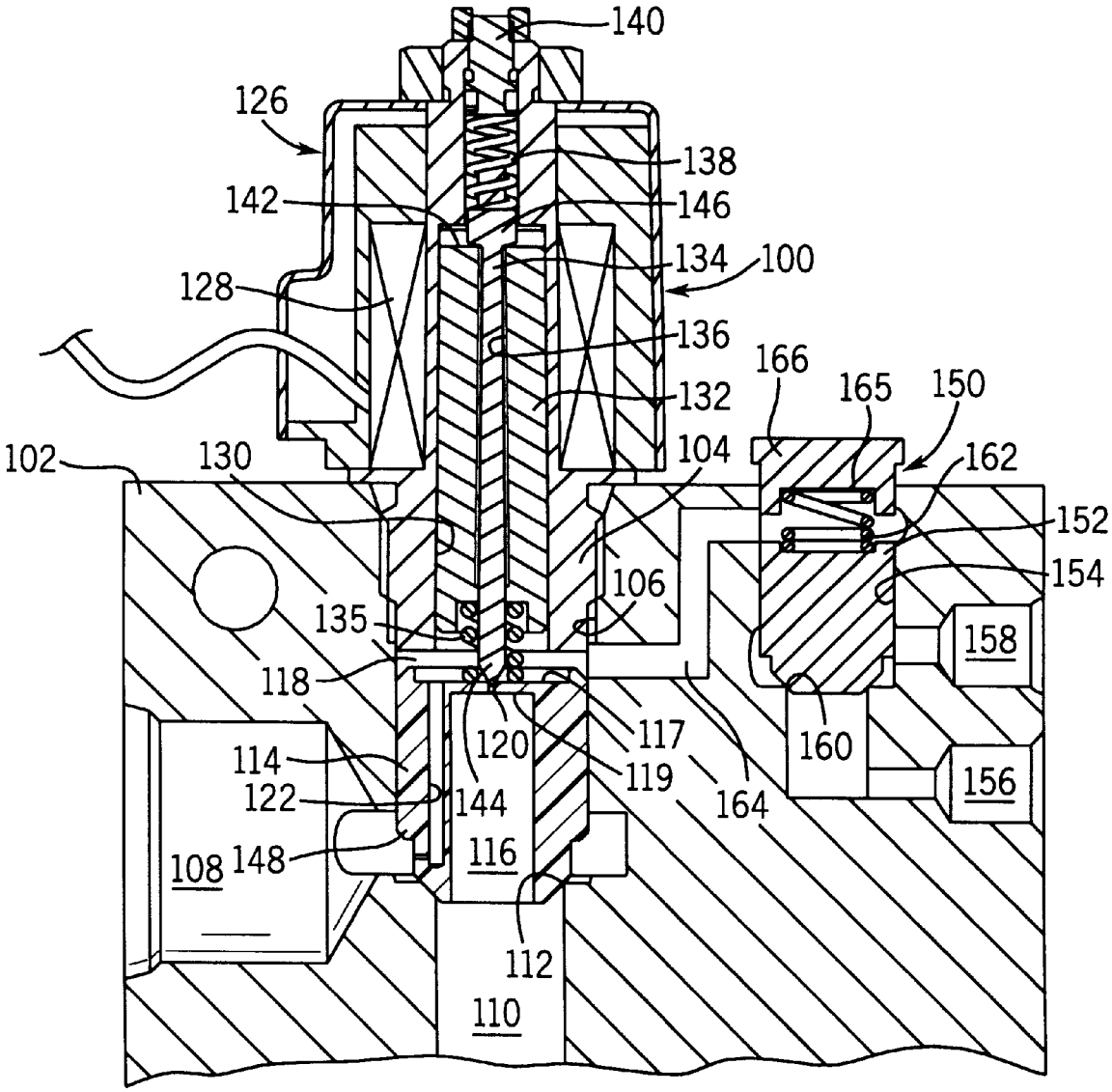
FIG. 2 is a cross sectional view of a control valve assembly containing a main control valve and a shadow poppet valve.

Each of the control valves 21–24 is a solenoid operated pilot type, such as the one shown in FIG. 2. This solenoid valve 100 comprises a cylindrical valve cartridge 104 mounted in a longitudinal bore 106 of a valve body 102. The valve body 102 has a transverse inlet 108 which communicates with the longitudinal bore 106. An outlet 110 extends from an interior end of the longitudinal bore 106 through the valve body 102. A valve seat 112 is formed between the inlet and outlet 108 and 110.

A main valve poppet 114 slides within the longitudinal bore 106 with respect to the valve seat 112 to control flow of hydraulic fluid between the inlet and outlet. A central cavity 116 is formed in the main valve poppet 114 and extends from an opening at the outlet 110 to a closed end 117. The thickness of the wall at the closed end 117 forms a flexible diaphragm 119 and a pilot passage 120 extends through that diaphragm. The main valve poppet 114 defines control chamber 118 in the longitudinal bore 106 on the remote side of the diaphragm 119 from central cavity 116. The opposite sides of the diaphragm 119 are exposed to the pressures in the control chamber 118 and the poppet's central cavity 116. A inlet passage 122 extends from a control orifice 123 opening into the inlet 108 through the main valve poppet 114 to the control chamber 118.

Movement of the main valve poppet 114 is controlled by a solenoid 126 comprising an electromagnetic coil 128, an armature 132 and a pilot poppet 134. The armature 132 is positioned within a bore 130 through the cartridge 104 and a first spring 135 biases the main valve poppet 114 away from the armature. The pilot poppet 134 is located within a bore 136 of the tubular armature 132 and is biased toward the armature by a second spring 138 that engages an adjusting screw 140 threaded into the cartridge bore 130. The solenoid has an electromagnetic coil 128 located around and secured to cartridge 104. The armature 132 slides within the cartridge bore 130 away from main valve poppet 114 in response to an electromagnetic field created by applying electric current to energize the electromagnetic coil 128.

In the de-energized state of the electromagnetic coil 128, a second spring 138 forces the pilot poppet 134 against end 142 of the armature 132, pushing both the armature and the pilot poppet toward the main valve poppet 114. This results in a conical tip 144 of the pilot poppet 134 entering and closing the pilot passage 120 in the main valve poppet, thereby terminating cutting off communication between the control chamber 118 and the outlet 110.

The valve assemblies containing the first, second, and third control valves 21–23 also contain the associated first, second, or third shadow poppet valve 31, 32 or 33, respectively. With continuing reference to FIG. 2, the shadow poppet valve 150, associated with control valve 100 comprises a shadow poppet 152, is slidably received in an auxiliary bore 154 in the valve body 102. The inner end of the auxiliary bore 154 opens into an outlet 156 of the shadow poppet valve 150. An inlet 158 for the shadow poppet valve 150 opens into the auxiliary bore 154 which has a valve seat 160 between the inlet and outlet.

An auxiliary control chamber 162 is formed in the auxiliary bore 154 on the remote side of the shadow poppet 152 from the valve seat 160. A passage 164 connects the auxiliary control chamber 162 of the shadow poppet valve 150 to the control chamber 118 of the control valve 100. A spring 165 biases the shadow poppet 152 away from a cap 166 and against the valve seat 160.

Energizing the solenoid valve 100 controls the flow of hydraulic fluid between the inlet and outlet 108 and 110 of the control valve 100 in FIG. 2. The rate of hydraulic fluid flow through the valve is directly proportional to the magnitude of electric current applied to the coil 128. The electric current generates an electromagnetic field which draws the armature 132 into the solenoid coil 128 and away from the main valve poppet 114. Because end 142 of the armature 132 engages a shoulder 146 on the pilot poppet 134, that latter element also moves away from the main valve poppet 114, thereby allowing hydraulic fluid to flow from the inlet 108 through the control orifice 122, control chamber 118, pilot metering passage 120, and the outlet 110.

The flow of hydraulic fluid through the pilot passage 120 reduces the pressure in the main control chamber 118 to that of the outlet. Thus the higher inlet pressure that is applied to the surface 148 forces main valve poppet 114 away from valve seat 112, thereby opening direct communication between the inlet 108 and the outlet 110. Movement of the main valve poppet 114 continues until contact occurs with the conical tip 144 of the pilot poppet 134. Thus, the size of this valve opening and the flow rate of hydraulic fluid there through are determined by the position of the armature 132 and pilot poppet 134. Those positions are in turn controlled by the magnitude of current flowing through electromagnetic coil 128.

As the flow of hydraulic fluid through the pilot passage 120 of the control valve 100 reduces the pressure in main control chamber 118, that reduced pressure is communicated to the auxiliary control chamber 162 of the shadow poppet valve 150. Thus the higher pressure at inlet 158 forces shadow poppet 152 away from valve seat 160, thereby opening communication between the inlet 158 and the outlet 156 of the shadow poppet valve 150. Simultaneous movement of the shadow valve requires common pressure levels in inlets 108 and 158 and in outlets 110 and 156. In the series mode, these pressures will not be identical. The upstream shadow valve 150 will open first as its pressure at inlet 158 will be higher. This is desirable as the motor control of speed is accomplished with the downstream poppet valve.

As the control valve 100 closes the pressure in the main control chamber 118 increases and is communicated to the auxiliary control chamber 162 of the shadow poppet valve 150. This produces a corresponding closure of the shadow poppet valve. Thus the operation of the shadow poppet valve 150 follows that of the control valve 100.

This assembly of a master control valve 100 and a slave shadow poppet valve 150 is employed to control the motors 16 and 18 in FIG. 1. When the hydraulic system 10 is used in a lift hoist, the operator moves a joystick 38 to raise a load. The microcomputer based controller 40 responds to the signal from the joystick 38 by producing electrical solenoid drive signals which open the first and third control valves 21 and 23. When a control valve and its associated shadow valve are connected in series, as are the first control valve 21 and the first shadow valve 31, the control valve must be connected downstream of its associated shadow valve. Thus as the first control valve 21 opens in response to the signal from the controller 40, the first shadow poppet valve 31 opens a corresponding amount. This action applies pressurized fluid from the pump 12 into the first port 26 of the first motor 16 and through the first control valve 21 to the first port 28 of the second motor 18. The degree to which the first control valve 21 and the first shadow poppet valve 31 open is controlled by the amount of electric current that the controller applies to the electromagnetic coil in the first control valve.

At the same time the electronic controller 40 opens the third control valve 23 which results in a corresponding opening of the associated upstream third shadow poppet 33 due to the coupling of the control chambers of those valves. Opening these latter valves 23 and 33 provides paths for fluid to exit the first and second motors 16 and 18 from their respective second ports 27 and 29 and return to the tank 14. In the load raising mode, the second and fourth control valves 22 and 24, as well as the associated second shadow poppet valve 32, are closed.

This valve action in the load raising mode, drives the two motors 16 and 18 in parallel applying force from both motors to the hoist cable spool. A relatively large amount of mechanical force is produced to raise the load, albeit at a relatively slow rate.

The electronic controller 40 receives a signal from a pressure sensor 42 at the output of pump 12 and opens a relief valve 44 when that pressure exceeds a predefined safety limit. Alternatively, a hydro-mechanical load sensor may be employed to provide a pressure relief mechanism. Other pressure sensors 46 are placed in the lines connected to the ports of the motors 16 and 18 to provide signals to the electronic controller 40 which indicate the pressure at those locations.

When the hoist is desired to lower a load, the operator places the joystick 38 into the lowering position. The controller 40 responds by entering the lowering mode in which electricity is applied to the coils of only the second and fourth control valves 22 and 24. The first and third control valves 21 and 23, as well as their associated first and third shadow poppet valves 31 and 33, are held closed.

Opening the fourth control valve 24 sends pressurized hydraulic fluid to the second port 29 of the second motor 18. Note that the fourth control valve 24 is not associated with a shadow poppet valve and has merely the structure of the solenoid proportional control valve 100 in FIG. 2. Opening the second control valve 22 produces a corresponding opening of the upstream second shadow poppet valve 32 due to interconnection of their control chambers. This provides a path through the second shadow poppet valve 32 for fluid exiting the first port 28 of the second motor 18 to enter the second port 27 of the first motor 16. This fluid exits the first port 26 of the first motor 16 and flows through the second control valve 22 to the tank 14. Thus the two motors 16 and 18 are connected in series resulting in the spool being driven relatively fast, i.e. faster than when the motors are connected in parallel. Series connected motors apply less force to the load than parallel connected motors, but this is acceptable as gravity aids in lowering the lift hoist load.

Figure 3:
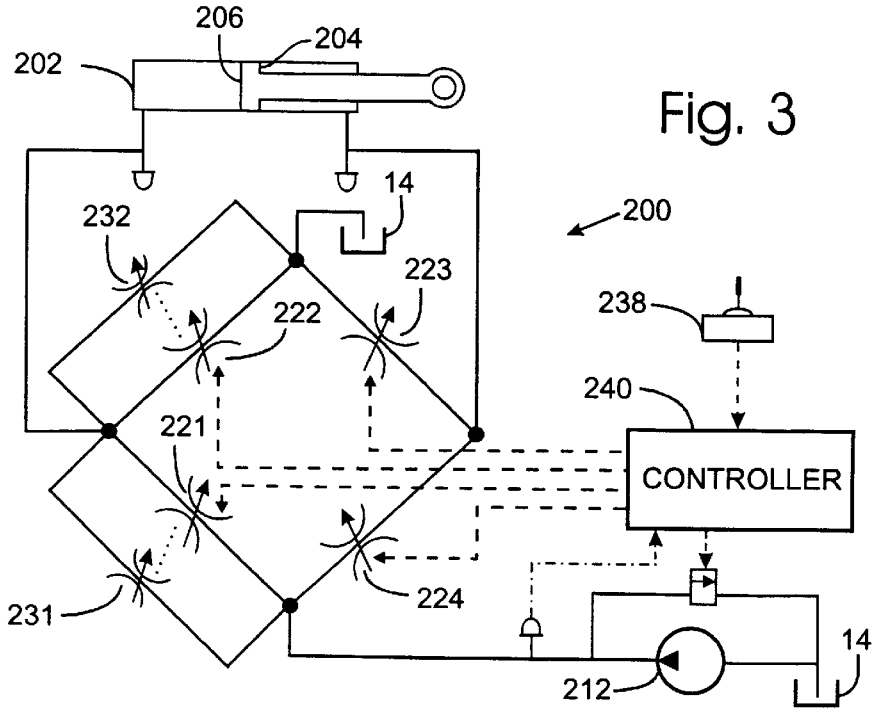
FIG. 3 a schematic representation of another hydraulic system that incorporates the present invention.

The shadow metering concept is a method to provide higher flow capability for a given poppet and solenoid size. For example, with reference to FIG. 3, a cylinder 202 has unequal piston area between the rod and head sides 204 and 206, respectively. The difference in area dictates a difference in flow into each chamber of the cylinder 202 in order to achieve the same relative speed of piston movement in both directions. Furthermore the amount of flow on the head side 206 that is required to move the piston at an effective speed may necessitate a relatively large control valve. It may not be practical in many installations to provide a single control valve that is large enough. Thus the cylinder 202 is connected to the novel hydraulic circuit 200 which is operated by a controller 240 in response to a joystick mechanism 238.

The cylinder 202 is connected to a four proportional control valves 221–224 each which is connected to either a pump 212 and a tank 214. The first proportional control valve 221 and its associated first shadow poppet valve 231 are connected in parallel with and is tied to operate in unison. Similarly, a second shadow poppet valve 232 is connected in parallel with the second proportional control valve 222 and is tied to operate in unison. Thus, since greater flow is required because of the larger volume of the cylinder chamber on the piston side 206, the valves which control the flow of fluid into and out of that side of the piston have shadow poppet valves. The third and fourth proportional control valve 223 and 224 in this hydraulic circuit 200 do not require shadow poppet valves.

Figure 4:
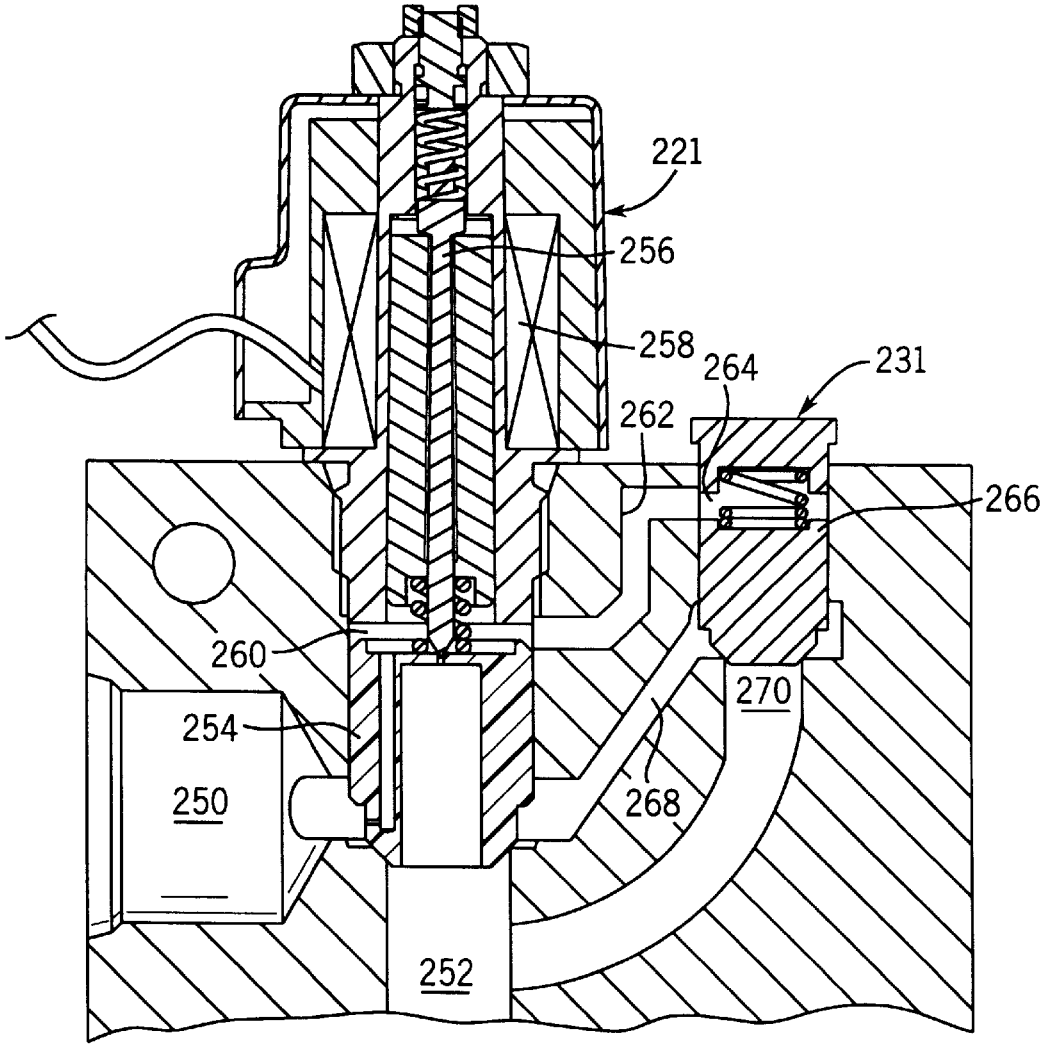
FIG. 4 is a cross sectional view of a control valve assembly containing a main control valve and a shadow poppet valve connected in parallel.

FIG. 4 illustrates the details of the first proportional control valve 221 and its associated shadow valve 231 with the understanding that the second proportional control valve 222 and its associated shadow valve 232 utilized the same assembly of components. The proportional control valve 221 has the same structure as described previously with respect to the proportional control valve 100 shown in FIG. 2. In particular, the proportional control valve 221 has an inlet port 250 and an outlet port 252 with the flow there between controlled by a main valve poppet 254. The main valve poppet is controlled by a pilot poppet 256 which is operated by a solenoid mechanism 258.

The proportional control valve 221 has a control chamber 260 which is connected by a passage 262 to the control chamber 264 of the shadow valve 231. The pressure in the control chamber 264 determines the position of the poppet 266 of the shadow valve 231. The position of the poppet 266 controls the flow of fluid from a inlet 268 to the shadow valve 231 which is connected by passage to the inlet 250 of the proportional control valve 221. The shadow valve 231 has an outlet 270 connected by a passage to the outlet 252 of the proportional control valve 221. Thus, the shadow valve 231 is connected in parallel with the main valve of the proportional control valve 221.

What is claimed is:

1. A hydraulic valve assembly comprising:

a main control valve for connection to a first hydraulic operator and having a main valve poppet slidably located within a first bore to control flow of fluid between a first inlet and a first outlet and defining a first control chamber on a side of the main valve poppet that is remote from the first outlet, and a selectively moveable pilot poppet engaging and controlling movement of the main valve poppet; and a shadow valve for connection to a second hydraulic operator and having a shadow poppet slidably located within a second bore to control flow of fluid between a second inlet and a second outlet, a second control chamber formed on a side of the shadow poppet that is remote from the second outlet and the second control chamber being in fluid communication with the first control chamber;

wherein movement of the pilot poppet affects pressure in the first control chamber and in the second control chamber thus producing corresponding movement of the shadow poppet and the main valve poppet.

2. The hydraulic valve assembly recited in claim 1 wherein the main valve poppet has a pilot passage extending there through from the first control chamber to the first outlet; and the pilot poppet selectively opens and closes the pilot passage.

3. The hydraulic valve assembly recited in claim 2 further comprising an inlet passage extending from the first inlet to the first control chamber.

4. The hydraulic valve assembly recited in claim 1 further comprising a valve body into which the first bore and the second bore are formed.

5. A hydraulic valve assembly comprising:

a main control valve for connection to a hydraulic operator and having a main valve poppet slidably located within a first bore to control flow of fluid between a first inlet and a first outlet and defining a first control chamber on a side of the main valve poppet that is remote from the first outlet, and a selectively moveable pilot poppet engaging and controlling movement of the main valve poppet;

a shadow valve having a shadow poppet slidably located within a second bore to control flow of fluid between a second inlet and a second outlet, a second control chamber formed on a side of the shadow poppet that is remote from the second outlet;

a first passage connecting the first inlet to the second inlet;

a second passage connecting the first outlet to the second outlet; and a third passage connecting the first control chamber to the second control chamber, wherein movement of the pilot poppet affects pressure in the first control chamber and in the second control chamber thus producing movement of the shadow poppet in unison with movement of the main valve poppet.

6. The hydraulic valve assembly recited in claim 5 wherein the main valve poppet has a pilot passage extending there through from the first control chamber to the first outlet; and the pilot poppet selectively opens and closes the pilot passage.

7. The hydraulic valve assembly recited in claim 6 further comprising an inlet passage extending from the first inlet to the first control chamber.

8. The hydraulic valve assembly recited in claim 5 further comprising a valve body into which the first bore and the second bore are formed.

9. A hydraulic system comprising:

a pump;

a tank;

a first hydraulic operator having a first port and a second port;

a second hydraulic operator having a first port and a second port;

a first valve assembly, a second valve assembly and a third valve assembly, each one of which comprises a main control valve and a shadow valve, wherein the main control valve has a main valve poppet slidably located within a first bore to control flow of fluid between a first inlet and a first outlet and defining a first control chamber on a side of the main valve poppet that is remote from the first outlet, and a selectively moveable pilot poppet engaging and controlling movement of the main valve poppet, and wherein the shadow valve has a shadow poppet slidably located within a second bore to control flow of fluid between a second inlet and a second outlet, a second control chamber formed on a side of the shadow poppet that is remote from the second outlet and the second control chamber in fluid communication with the first control chamber; and a proportional valve;

wherein the main control valve of the first valve assembly couples the pump to the first port of the first hydraulic operator and the shadow valve of the first valve assembly couples the first port of the first hydraulic operator to the first port of the second hydraulic operator, the main control valve of the second valve assembly couples the first port of the first hydraulic operator to the tank and the shadow valve of the second valve assembly couples the second port of the first hydraulic operator to the first port of the second hydraulic operator, the main control valve of the third valve assembly couples the second port of the first hydraulic operator to the tank and the shadow valve of the third valve assembly couples the second port of the first hydraulic operator to the second port of the second hydraulic operator, and the proportional valve couples the pump to the second port of the second hydraulic operator.

10. The hydraulic valve assembly recited in claim 9 wherein each of the first valve assembly, the second valve assembly and the third valve assembly further comprises an electric actuator which produces movement of the respective pilot poppet; and the proportional valve has another electric actuator.

11. The hydraulic valve assembly recited in claim 10 further comprising a controller electrically connected to the electric actuator of each of the first valve assembly, the second valve assembly and the third valve assembly, and having a first mode of operation in which the controller applies electricity to the electric actuator of the first valve assembly and to the electric actuator of the third valve assembly thereby operating the first and second operators in parallel, and having a second mode of operation in which the controller applies electricity to the electric actuator of the proportional valve and to the electric actuator of the second valve assembly thereby operating the first and second operators in series.

* * * * *